US006246169B1

(12) United States Patent
Pruvot

(10) Patent No.: US 6,246,169 B1
(45) Date of Patent: Jun. 12, 2001

(54) ELECTROLUMINESCENT LAMP AND HAVING A FLEXIBLE DOME-SHAPED SUBSTRATE

(75) Inventor: Anthony Pruvot, Chateau-Gontier (FR)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/190,551

(22) Filed: Nov. 12, 1998

(30) Foreign Application Priority Data

Nov. 17, 1997 (EP) ..... 97120090

(51) Int. Cl.[7] ..... H01J 1/62

(52) U.S. Cl. ..... 313/506; 313/509; 313/511; 200/314

(58) Field of Search ..... 313/506, 509, 313/511, 512; 200/5 A, 5 R, 308, 310, 311–317, 514; 315/169.3

(56) References Cited

U.S. PATENT DOCUMENTS

| | | | |
|---|---|---|---|
| 2,714,683 | 8/1955 | Jenkins | 313/109 |
| 2,900,545 | 8/1959 | Rulon et al. | 313/108 |
| 2,919,366 | 12/1959 | Mash | 313/108 |
| 2,981,858 | 4/1961 | O'Connell | 313/108 |
| 3,074,816 | 1/1963 | Blazek | 117/211 |
| 3,226,272 | 12/1965 | Longfellow | 156/67 |
| 4,060,703 | 11/1977 | Everett, Jr. | 200/5 A |
| 4,320,268 | 3/1982 | Brown | 200/314 |
| 4,343,975 | 8/1982 | Sado | 200/314 |
| 4,532,395 | 7/1985 | Zukowski | 200/314 |
| 4,598,181 | 7/1986 | Selby | 200/5 A |
| 4,683,360 | 7/1987 | Maser | 200/314 |
| 4,811,175 | 3/1989 | DeSmet | 362/95 |
| 4,818,829 | 4/1989 | Nopper et al. | 200/512 |
| 4,916,262 | 4/1990 | Jungles-Butler et al. | 220/5 A |
| 5,149,923 | 9/1992 | Demeo | 200/5 A |
| 5,184,968 | 2/1993 | Sharpless et al. | 445/24 |
| 5,280,146 | 1/1994 | Inagaki et al. | 200/341 |
| 5,508,585 | 4/1996 | Butt | 313/509 |
| 5,620,348 | 4/1997 | Santana et al. | 445/24 |
| 5,660,573 | 8/1997 | Butt | 445/24 |
| 5,664,667 | 9/1997 | Kenmochi | 200/314 |
| 5,669,486 | 9/1997 | Shima | 200/314 |
| 5,791,459 | 8/1998 | Hester et al. | 200/512 |
| 5,797,482 * | 8/1998 | LaPointe et al. | 200/314 |
| 5,847,336 * | 12/1998 | Thornton | 200/5 A |
| 5,871,088 * | 2/1999 | Tanabe | 200/514 |
| 5,960,942 * | 10/1999 | Thornton | 200/314 |
| 6,100,478 * | 8/2000 | LaPointe et al. | 200/314 |

FOREIGN PATENT DOCUMENTS

| | | | |
|---|---|---|---|
| 1221707 | 7/1966 | (DE) . | |
| 2512228 | 10/1975 | (DE) | H01H/13/52 |
| 3045962 | 7/1979 | (DE) | H01H/13/70 |
| 3511496A1 | 3/1985 | (DE) | H01H/9/18 |
| 0818793A1 | 3/1998 | (EP) | H01H/13/02 |
| 56-96416 | 8/1981 | (JP) | H01H/13/02 |
| 62-37137 | 3/1987 | (JP) | H01H/13/20 |
| 63-199421 | 12/1988 | (JP) | H01H/13/02 |
| 64-47524 | 2/1989 | (JP) | B29C/51/08 |
| 10-222271 | 8/1998 | (JP) | G06F/3/02 |
| WO 94/14180 | 6/1994 | (WO) | H01J/1/62 |

* cited by examiner

*Primary Examiner*—Nimeshkumar D. Patel
*Assistant Examiner*—Karabi Guharay
(74) *Attorney, Agent, or Firm*—Robert A. Yesukevich

(57) ABSTRACT

An electroluminescent lamp includes a flexible dome-shaped, light transmissive substrate defining a top convex side and a bottom concave side thereof. An upper light transmissive electrode layer is disposed on at least a portion of the bottom concave side of the dome-shaped substrate. An electroluminescent layer is disposed below the upper light transmissive electrode layer. A lower electrode layer is disposed below the electroluminescent layer. A method is contemplated whereby the layers are applied to the top of the substrate, the substrate is inverted and then formed into its dome-shaped configuration.

16 Claims, 5 Drawing Sheets

ELECTROLUMINESCENT LAMP AND HAVING A FLEXIBLE DOME-SHAPED SUBSTRATE

FIELD OF THE INVENTION

This invention generally relates to the art of electroluminescent lamps and, particularly, to an electroluminescent lamp particularly adapted for use in a key pad.

BACKGROUND OF THE INVENTION

Electroluminescent lamp panels are known in the art. In general, an electroluminescent lamp typically includes a base electrode spaced from a transparent electrode for sandwiching an electroluminescent or phosphorescent layer therebetween. Often a dielectric layer also is sandwiched between the two electrodes. The base electrode may be a foil layer, such as a thin aluminum foil layer, or the base electrode may be a printed layer of conductive ink. Conductive leads extend from the base and transparent electrodes of the lamp. When an AC voltage is applied across the leads, the current induced between the base and transparent electrodes causes the phosphorescent layer to emit light, a phenomenon known as luminescence. An electroluminescent lamp essentially is a light emitting capacitor having a dielectric layer between two conductive electrodes, one of which is transparent, and the dielectric layer may be a phosphorescent layer, or there may be a separate dielectric layer. The transparent electrode layer typically is made of indium tin oxide ("ITO") or indium oxide. Light is visible through the transparent electrode, and various electroluminescent chemicals are known to provide lights of various colors. Lamp panels can include one or a plurality of individual electroluminescent lamps.

In a typical electroluminescent lamp panel used as a keyboard, individual electroluminescent switch keys are used to actuate individual circuits, and individual electroluminescent lamps are associated with each key. The respective lamp may or may not be energized by the associated key. In any event, each key includes a dome-shaped actuator key mounted on top of a spacer on top of a printed circuit board which, in turn, is mounted on top of the layered or laminated electroluminescent lamp. The actuator key moves a conductive switch member through a hole in the spacer to close a gap between two circuit traces on the board. The circuit board typically is separated from the laminated electroluminescent lamp by still a further insulator. In order for the lower electroluminescent lamp to light-up the actuator key, the components of the electrical circuit, including the printed circuit board substrate, the insulator and the switch member must be light-transmissive to allow light from the subjacent electroluminescent lamp to pass therethrough. Problems with such prior art structures center around the higher costs involved in their fabrication as well as the loss of light by diffusion through the many light-transmissive components between the electroluminescent lamp and the actuator as well as blockage by opaque components.

The present invention is directed to solving these various problems by providing a unique arrangement wherein the components of the electroluminescent lamp are located immediately below a substrate, such as a dome-shaped substrate which can function directly as a switch key.

SUMMARY OF THE INVENTION

An object, therefore, of the invention is to provide a new and improved electroluminescent lamp, particularly such a lamp which is especially applicable for use in an electroluminescent lamp panel or keyboard, as well as a method of fabricating an electroluminescent key.

In the exemplary embodiment of the invention, the electroluminescent lamp includes a flexible dome-shaped, light transmissive substrate defining a top side and a bottom side thereof. An upper light transmissive electrode layer is applied on at least a portion of the bottom side of the dome-shaped substrate. An electroluminescent layer is applied below the upper light transmissive electrode layer. A lower electrode layer is applied below the electroluminescent layer. Therefore, running electrical current through the upper and lower electrode layers causes the electroluminescent layer to emit light through the upper electrode layer and directly through the flexible dome-shaped substrate. There are no extraneous circuits or circuit boards disposed between the electroluminescent lamp and the dome-shaped substrate or key.

As disclosed herein, the flexible dome-shaped substrate is preferably fabricated of polycarbonate, but other soft plastic materials may be suitable. A dielectric layer may be disposed between the electroluminescent layer and the lower electrode layer. A layer of graphic ink may be applied on the bottom side of the dome-shaped substrate. A layer of easily stretchable conductive material may be applied about at least a portion of the upper electrode layer for connecting the upper electrode layer to an electrical circuit. A silicone material may be provided under the concave side of the dome-shaped substrate.

The flexible dome-shaped substrate includes a peripheral side wall and a top wall. The peripheral side wall is preferably at an obtuse angle with respect to the top wall. The upper electrode layer and the electroluminescent layer are located beneath the top wall of the dome-shaped substrate. Still further, the flexible dome-shaped substrate is shown to be substantially surrounded by a generally flat substrate separated from the dome-shaped substrate by a peripheral cutout.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
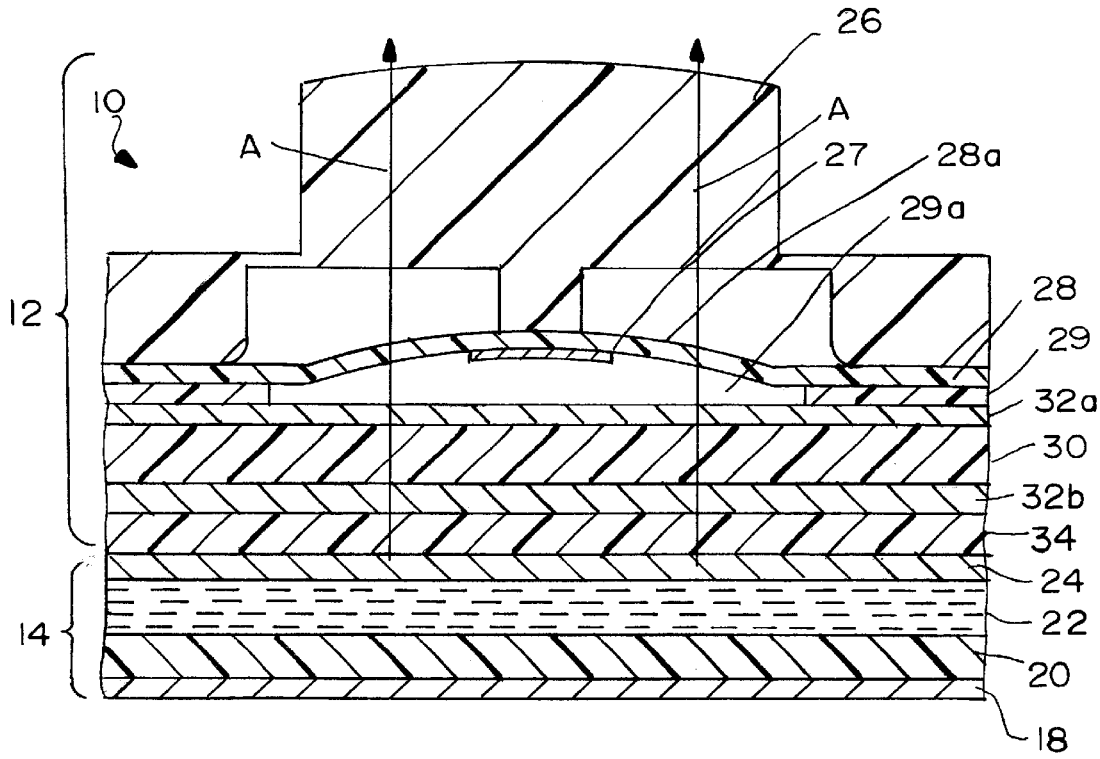
FIG. 1 (PRIOR ART)
FIG. 1 is a fragmented section through an electroluminescent switch key of the prior art.
Figure 2:
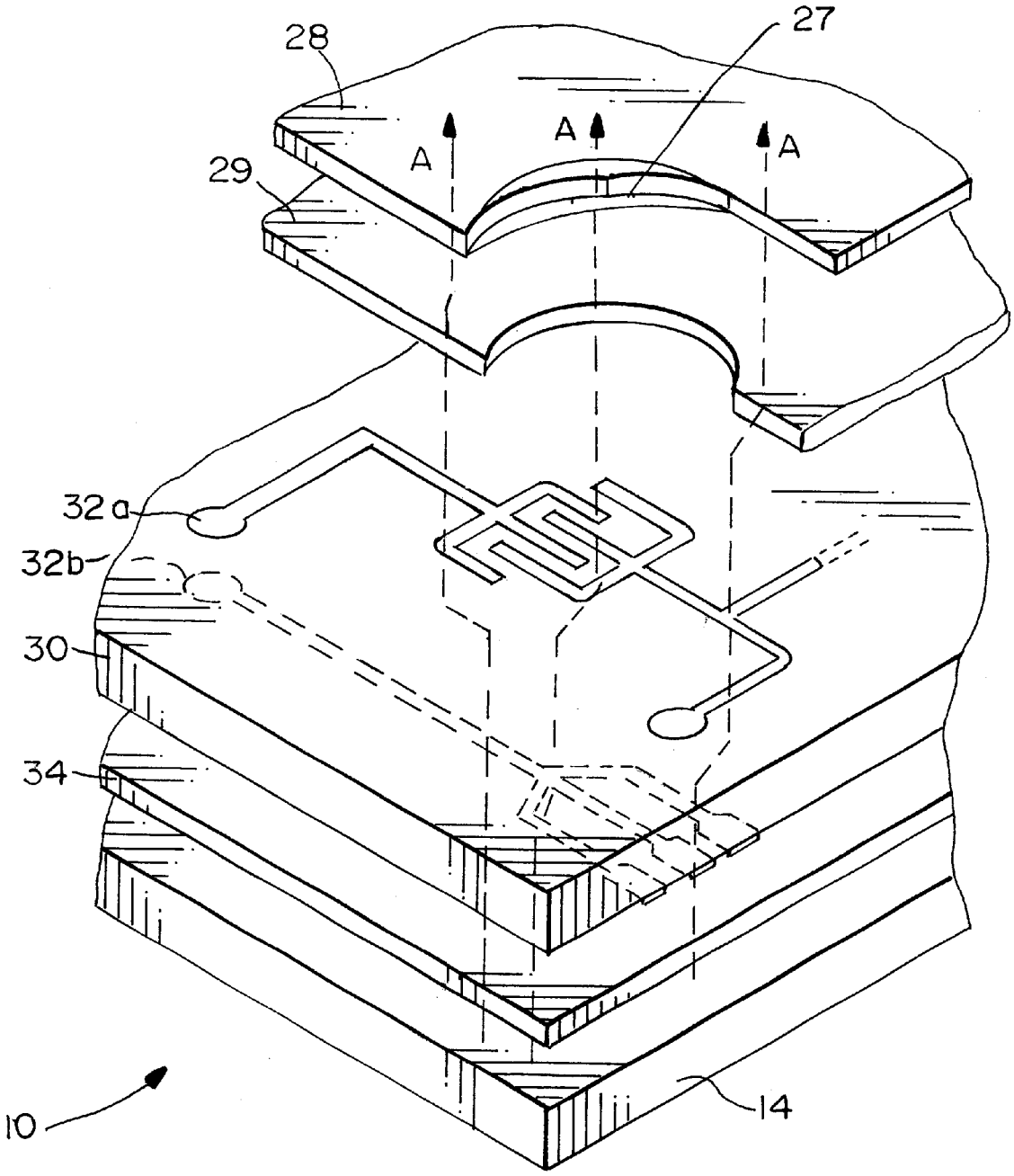
FIG. 2 (PRIOR ART)
FIG. 2 is an exploded perspective view of the switch key in FIG. 1 without the actuator.

Referring to the drawings in greater detail, and first to FIGS. 1 and 2, an electroluminescent switch key, generally designated 10, is shown according to a prior art construction. The switch key includes a switch assembly 12 on top of an electroluminescent lamp 14.

The key assembly 12 includes a silicone-filled actuator 26 mounted on top of a translucent layer 28 with a dome 28*a* which, in turn, is mounted on top of a spacer 29 having a recess 29*a* therein. The spacer 29 is mounted on top of a printed circuit board 30 having circuit traces 32*a* and 32*b* printed on both sides thereof. A translucent insulating layer 34 supports the key assembly 12.

The electroluminescent lamp is of a typical construction and is applied onto the opposite side of the insulating layer 34 as the key assembly 12. A translucent electrode layer 24, typically of indium tin oxide ("ITO"), is applied, such as by sputter coating, over the bottom of the insulating layer 34. A phosphor layer 22 is printed on the electrode layer 24. A dielectric layer 20 is applied over the phosphor layer 24. A lower electrode layer 18 is applied onto the dielectric layer 20. The lower electrode layer may be of conductive ink, such as silver ink, screen printed on the dielectric layer 20. When an AC voltage is applied across leads from electrode layers 18 and 24, the current induced between the electrodes causes the phosphor layer 22 to emit light, a phenomenon known as luminescence. The light can pass upwardly in the direction of arrows "A" through translucent electrode layer 24 and the translucent components of the key assembly.

Not only is the prior art construction of electroluminescent switch key 10 in FIGS. 1 and 2 more expensive to manufacture, but light is lost by diffusion and blockage of the light by all of the components of the printed circuit board and the switch before the light ever reaches actuator key 26.

Figure 3:
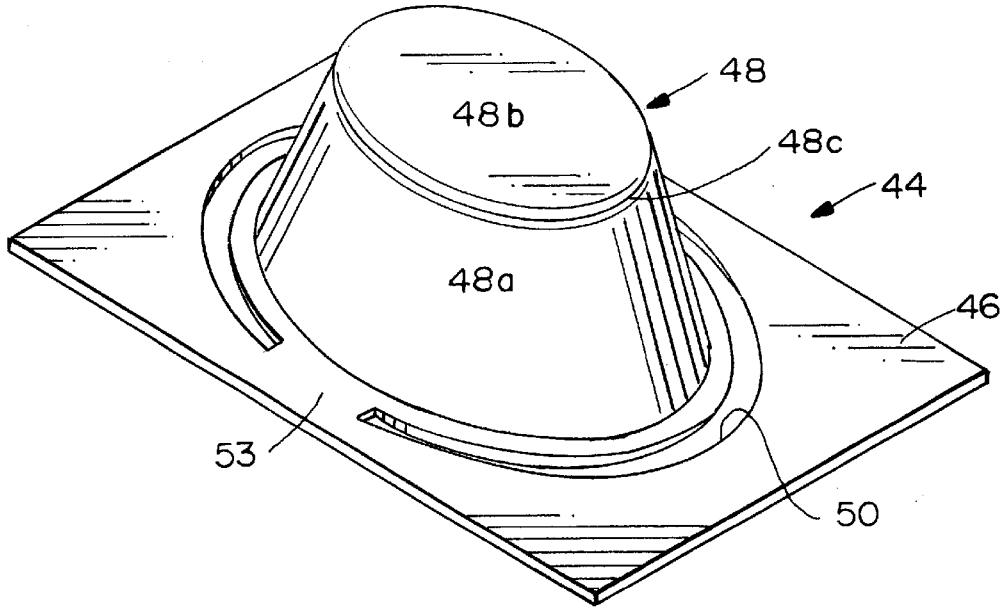
FIG. 3 is a perspective of a switch key incorporating the concepts of the invention.

Referring to FIG. 3, the electroluminescent lamp of the invention is incorporated in a key pad, generally designated 44. The key pad includes a generally flat or planar substrate 46, with a generally dome-shaped key or substrate portion, generally designated 48, formed therefrom. Key 48 is separated from flat substrate 46 by an annular peripheral cutout 50, except for a web portion 53, for purposes described hereinafter. Key 48 has a peripheral side wall 48*a* and a top wall 48*b* which gradually merge at a curved bend 48*c*. It can be seen that the side wall 48*a*, the top wall 48*b* and the bend 48*c* together define a generally convex surface when viewed from above the key 48 and a generally concave surface when viewed from below the key 48. The peripheral side wall 48*a* is preferably at an obtuse angle with respect to the top wall. The entire substrate structure, including flat substrate 46 and dome-shaped substrate or key 48 is fabricated of a layer of flexible material, preferably fabricated of polycarbonate.

Before proceeding, it should be understood that the structure shown in FIG. 3 has dome-shaped key 48 projecting upwardly from flat substrate 46. This would be the normal orientation of the structure as used in a typical keyboard or luminescent lamp panel. Therefore, when using such terms as "upper", "lower", "top", "bottom" and the like is meant to be in reference to this orientation.

Figure 4:
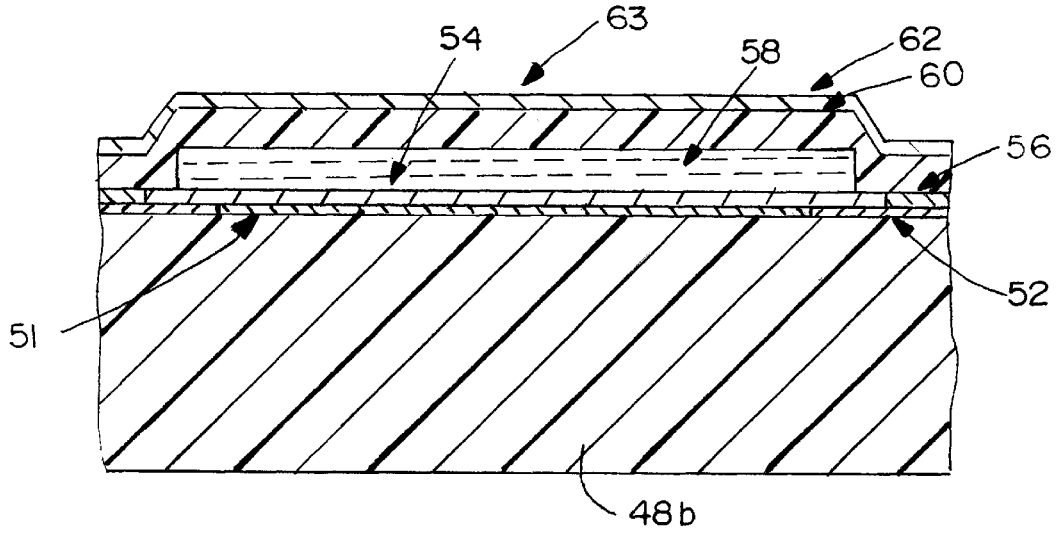
FIG. 4 is a fragmented section of the layered electroluminescent lamp prior to forming the lamp into a switch key.

With the understanding set forth immediately above, reference now is made to FIG. 4 wherein the initial steps in fabricating the luminescent lamp (or key) are illustrated. Layer 48*b* in FIG. 4 represents the top wall of dome-shaped substrate or key 48 in an upside-down orientation and prior to forming the substrate into its dome-shaped configuration. In fabricating the luminescent lamp of the invention, graphic ink layers 51 and 52 first are printed on polycarbonate substrate 48*b*. At least graphic layer 51 is light transmitting. A light-transmissive electrode layer 54 is sputtered on graphic inks 51 and 52. This electrode layer will become the upper electrode layer in dome-shaped key 48 (FIG. 3). This electrode layer may be made of indium tin oxide ("ITO") material. A layer 56 of easily stretchable conductive ink also is printed on graphic layers 51 and 52 for connecting electrode 54 to a supporting electrical circuit, as will be seen in greater detail hereinafter. This easily stretchable conductive ink can be silver ink, but carbon ink is preferable for embossing purposes. An electroluminescent layer 58 of preferably phosphor is printed on top of electrode layer 54. A light-transmissive, dielectric layer 60 is printed over electroluminescent layer 58. Finally, a second electrode layer 62 is printed over dielectric layer 60. This second electrode layer may be of silver ink, and this conductive layer eventually becomes the rear or lower electrode layer beneath dome-shaped substrate of key 48 (FIG. 3). These fabrication steps form an electroluminescent lamp, generally designated 63 in FIG. 4.

Figure 5:
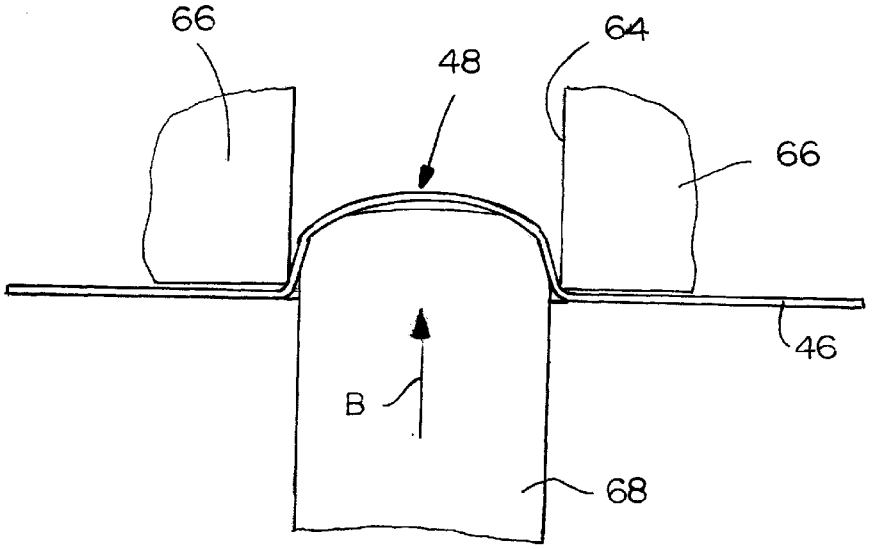
FIG. 5 is a somewhat schematic illustration of the forming process of the switch key.
Figure 6:
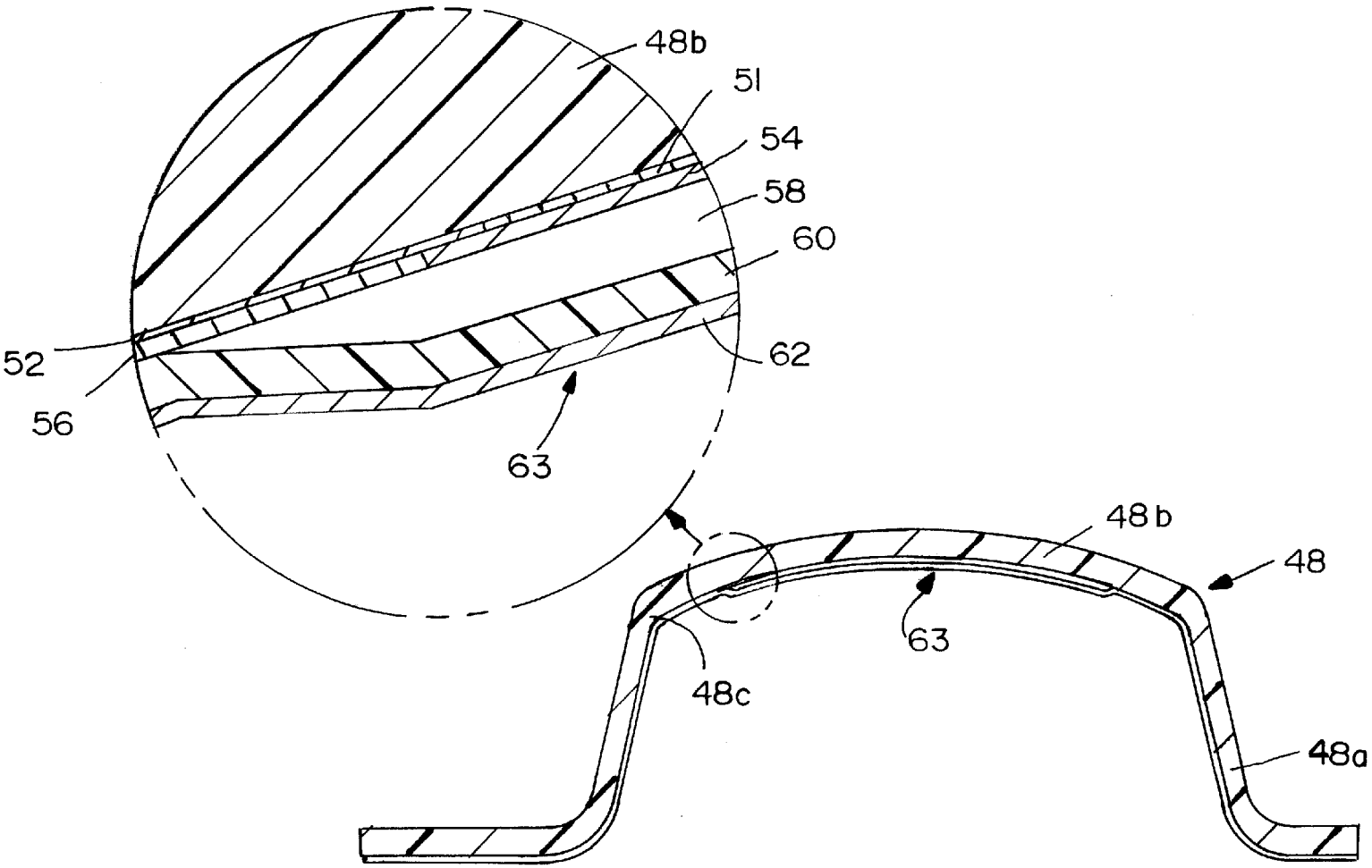
FIG. 6 is a section through the fully formed switch key.

The laminate described above in relation to FIG. 4 then is inverted and placed over an opening 64 in a die 66 as shown in FIG. 5. A forming die 68 then is moved into the laminate in the direction of arrow "B" to emboss or form the laminate into the configuration shown in FIG. 6 which now corresponds to the orientation of dome-shaped substrate or key 48 in FIG. 3. It can be seen in FIG. 6 that the electroluminescent lamp 63 (FIG. 4) now is located directly under top wall 48*b* of the dome-shaped key. Light transmissive electrode 54 now is the upper electrode, and electrode layer 62 now is the lower electrode beneath the top wall of the key. Cutout 50 (FIG. 3) is stamped out of flat substrate 46 after the dome-shaped substrate or key 48 is formed as described above. The underside of the key may then be filled with silicone material. Preferably, a silicone form is inserted under the key.

Figure 7:
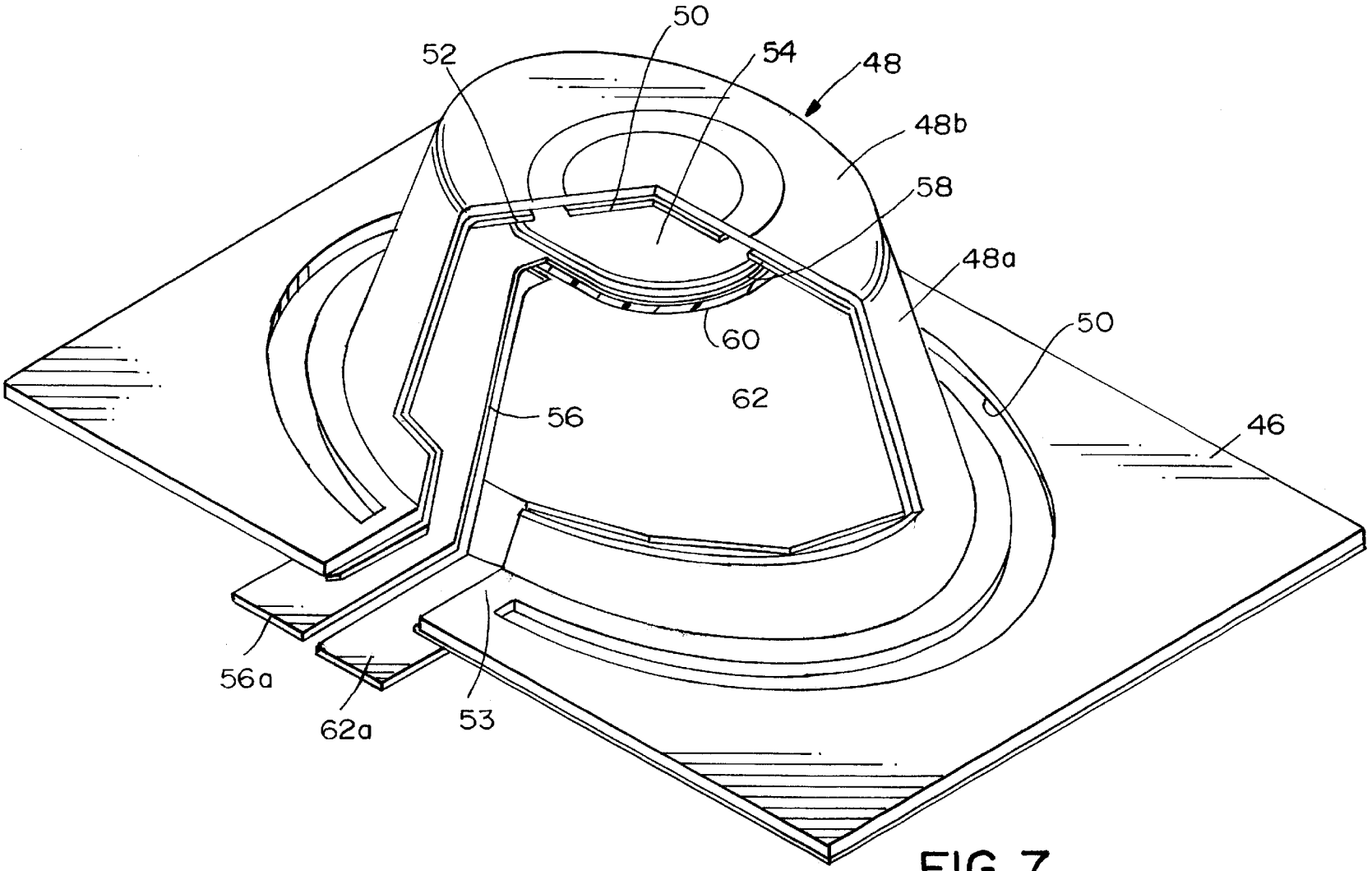
FIG. 7 is a perspective view of the final switch key, including the surrounding substrate and electrical leads therefore.

FIG. 7 shows the final construction of the electroluminescent lamp and key of the invention. It can be seen that carbon layer 56, which is connected to upper light transmissive electrode layer 54, has a lead portion 56*a* projecting generally radially outwardly of the substrate structure. Lower electrode layer 62 has a lead portion 62*a* which also projects radially outwardly of the substrate structure. Web portion 53 of the substrate structure not only supports the dome-shaped substrate or key 48 within the cutout 50 of flat substrate 46, but the web portion also can be used to support leads 56*a* and 62*a*. When AC voltage is applied across leads 56*a* and 62*a*, current is induced between electrode layers 54 and 62 which causes phosphorescent layer 58 to emit light upwardly through top wall 48*b* of dome-shaped substrate or key 48. Although it is not shown, a conventional electrical switch can be disposed below the key 48.

As best seen in FIG. 7, the upper light transmissive electrode 54 is restricted to an area beneath top wall 48*b* of key 48. Stretchable conductive layer 56 then connects the upper electrode across the bend 48*c* through lead 56*a* to the source of AC current. This arrangement is provided because the upper light transmissive electrode layer 54 is typically fabricated of indium tin oxide which is not as stretchable as layer 56. The more stretchable layer 56 can better withstand the stress and strain forces encountered while being formed into the dome configuration of key 48 than the less flexible indium tin oxide material of upper electrode layer 54.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electroluminescent lamp (63), comprising:

a flexible dome-shaped, light transmissive substrate (48) defining a top side and a bottom side thereof;

a generally flat substrate (46) which substantially surrounds said flexible dome-shaped substrate (48), the substrate (46) being separated from said flexible dome-shaped substrate (48) by a peripheral cutout (50), an upper light transmissive electrode layer (54) below at least a portion of the bottom side of the dome-shaped substrate;

an electroluminescent layer (58) below the upper light transmissive electrode layer (54); and a lower electrode layer (62) below the electroluminescent layer (58), whereby running electrical current through said upper and lower electrode layers (54, 62) causes said electroluminescent layer (58) to emit light through said upper electrode layer (54) and said flexible dome-shaped substrate (48).

2. The electroluminescent lamp of claim 1 wherein said flexible dome-shaped substrate (48) is fabricated of polycarbonate material.

3. The electroluminescent lamp of claim 1, including a dielectric layer (60) between the electroluminescent layer (58) and the lower electrode layer (62).

4. The electroluminescent lamp of claim 1, including a layer of graphic ink (50, 52) on the bottom side of the dome-shaped substrate (48).

5. The electroluminescent lamp of claim 1, including a layer of stretchable conductive material (56) about at least a portion of the upper electrode layer (54) for connecting the upper electrode layer to an electrical circuit.

6. The electroluminescent lamp of claim 1 wherein said flexible dome-shaped substrate (48) includes a peripheral side wall **(48*a*) and a top wall (48*b*)**, the peripheral side wall being at an obtuse angle with respect to the top wall.

7. The electroluminescent lamp of claim 6 wherein said upper electrode layer (54) and said electroluminescent layer (58) are located beneath said top wall **(48*b*) of the dome-shaped substrate (48)**.

8. The electroluminescent lamp of claim 1 wherein said dome-shaped substrate (48) is substantially filled with a silicone material.

9. The electroluminescent lamp of claim 1 wherein said flexible dome-shaped substrate (48) includes a peripheral side wall **(48*a*) and a top wall (48*b*), the side wall being at an obtuse angle with respect to the top wall (48*b*), and said upper electrode layer (54) being located beneath the top wall of the dome-shaped substrate (48)**.

10. The electroluminescent lamp of claim 9, including a layer of carbon material (56) connecting the upper electrode layer (54) along said peripheral side wall **(48*a*)** to an electrical circuit.

11. An electroluminescent key pad (44), comprising:

a flexible light transmissive substrate including a flat substrate portion (46) substantially surrounding a dome-shaped key portion (48), the key portion being separated from the substrate portion by a peripheral cut-out (50) and being attached thereto by a web portion (53), the key portion having a top side and a bottom side thereof;

an upper light transmissive electrode layer (54) below at least a portion of the bottom side of the dome-shaped key portion (48) of the substrate;

a layer (56) of stretchable conductive material extending from the upper electrode layer (54) for connecting the upper electrode layer to an electrical circuit;

an electroluminescent layer (58) below the upper light transmissive electrode layer (54);

a dielectric layer (60) below the electroluminescent layer (58); and a lower electrode layer (62) below the dielectric layer (60), whereby running electrical current through said lower electrode layer (62) and said stretchable conductive layer (56) and, thereby, through said upper electrode layer (54) causes said electroluminescent layer (58) to emit light through said upper electrode layer (54) and said dome-shaped key portion (48) of the flexible substrate.

12. The electroluminescent key pad of claim 11 wherein said flexible substrate (46, 48) is fabricated of polycarbonate material.

13. The electroluminescent key pad of claim 11, including a layer of graphic ink (50, 52) on the bottom concave side of the dome-shaped key portion (48) of the substrate.

14. The electroluminescent key pad of claim 11 wherein said stretchable conductive layer (56) is carbon ink.

15. The electroluminescent key pad of claim 11 wherein said dome-shaped key portion (48) of the flexible substrate includes a peripheral side wall **(48*a*) and a top wall (48*b*), the side wall (48*a*) being at an obtuse angle with respect to the top wall (48*b*)**.

16. The electroluminescent key pad of claim 15 wherein said upper electrode layer (54) is located beneath the top wall **(48*b*) of the dome-shaped key portion (48) of the substrate, and said stretchable conductive layer (56) extends from the upper electrode layer (54) along said peripheral side wall (48*a*) to the flat portion (46)** of the substrate.

* * * * *